US007867105B2

(12) United States Patent
Moon

(10) Patent No.: US 7,867,105 B2
(45) Date of Patent: Jan. 11, 2011

(54) FORGED IRON HEAD AND GOLF CLUB HAVING THE SAME

(76) Inventor: Seok Jin Moon, Hyundai Apt., #105-1601, 458-5, Yangjeong 1-dong, Pusanjin-gu, Pusan City (KR)

( * ) Notice: Subject to any disclaimer, the term of this patent is extended or adjusted under 35 U.S.C. 154(b) by 0 days.

(21) Appl. No.: 12/345,114

(22) Filed: Dec. 29, 2008

(65) Prior Publication Data

US 2009/0298615 A1 Dec. 3, 2009

(30) Foreign Application Priority Data

Jun. 2, 2008 (KR) ..... 10-2008-0051615

(51) Int. Cl.
*A63B 53/04* (2006.01)
*A63B 53/14* (2006.01)

(52) U.S. Cl. ..... 473/314; 473/345; 473/349; 473/350

(58) Field of Classification Search ..... 473/324–350, 473/287–292, 314; D21/747–749
See application file for complete search history.

(56) References Cited

U.S. PATENT DOCUMENTS 3,143,349 A * 8/1964 MacIntyre ..... 473/338
4,398,965 A * 8/1983 Campau ..... 148/522
4,630,825 A * 12/1986 Schmidt et al. ..... 473/287
5,050,879 A * 9/1991 Sun et al. ..... 473/338
5,062,638 A * 11/1991 Shira ..... 473/350
5,385,348 A * 1/1995 Wargo ..... 473/338
5,429,357 A * 7/1995 Kobayashi ..... 473/311
5,472,203 A * 12/1995 Schmidt et al. ..... 473/350
5,492,327 A * 2/1996 Biafore, Jr. ..... 473/332
5,564,705 A * 10/1996 Kobayashi et al. ..... 473/334
5,616,088 A * 4/1997 Aizawa et al. ..... 473/341
5,766,091 A * 6/1998 Humphrey et al. ..... 473/324
5,833,551 A * 11/1998 Vincent et al. ..... 473/350
5,938,540 A * 8/1999 Lu ..... 473/288
6,086,485 A * 7/2000 Hamada et al. ..... 473/329
6,290,607 B1 * 9/2001 Gilbert et al. ..... 473/291
6,497,629 B2 * 12/2002 Takeda ..... 473/324

(Continued)

FOREIGN PATENT DOCUMENTS

JP 2001-046560 2/2001

(Continued)

*Primary Examiner*—Sebastiano Passaniti
(74) *Attorney, Agent, or Firm*—Kile Park Goekjian Reed & McManus

(57) ABSTRACT

A forged iron head for a golf club has a face for hitting a golf ball, a top and a sole extending to upper and lower parts of a rear side of the face, a heel and a toe disposed between the sole and the top, a cavity disposed in the rear side of the face and surrounded by the sole, the top, the heel and the toe and a hosel coupled with a shaft extending from a first side of the face and having a handle part to be gripped by a player. The head comprises a hollow part with an opening formed from the sole toward a first side of the cavity, and a sole cover which closes the opening. The formation of the hollow part lowers the centroid of the iron head, thereby improving flight distances and direction of a golf ball.

11 Claims, 11 Drawing Sheets

U.S. PATENT DOCUMENTS

| | | | | |
|---|---|---|---|---|
| 6,592,468 | B2 * | 7/2003 | Vincent et al. | 473/334 |
| 6,709,345 | B2 * | 3/2004 | Iwata et al. | 473/291 |
| 6,881,158 | B2 * | 4/2005 | Yang et al. | 473/324 |
| 7,083,531 | B2 * | 8/2006 | Aguinaldo et al. | 473/350 |
| 7,086,964 | B2 * | 8/2006 | Chen et al. | 473/350 |
| 7,134,971 | B2 * | 11/2006 | Franklin et al. | 473/340 |
| 7,207,899 | B2 * | 4/2007 | Imamoto | 473/332 |
| 7,338,387 | B2 * | 3/2008 | Nycum et al. | 473/332 |
| 7,393,287 | B2 * | 7/2008 | Huang | 473/329 |
| 7,530,903 | B2 * | 5/2009 | Imamoto et al. | 473/335 |
| 2004/0023729 | A1 * | 2/2004 | Nagai et al. | 473/338 |
| 2005/0009626 | A1 | 1/2005 | Imamoto et al. | |
| 2005/0096151 | A1 * | 5/2005 | Hou et al. | 473/335 |
| 2007/0281796 | A1 * | 12/2007 | Gilbert et al. | 473/332 |

FOREIGN PATENT DOCUMENTS

| | | |
|---|---|---|
| JP | 2005-137634 | 6/2005 |
| JP | 3035480 | 6/2005 |
| KR | 10-2008-0031781 | 4/2008 |

* cited by examiner

FORGED IRON HEAD AND GOLF CLUB HAVING THE SAME

CROSS-REFERENCE TO RELATED APPLICATION

This application claims priority from Korean Patent Application No. 10-2008-0051615, filed on Jun. 2, 2008, in the Korean Intellectual Property Office, the disclosure of which is incorporated herein by reference.

BACKGROUND OF THE INVENTION

1. Field of the Invention

Apparatuses consistent with the present invention relate to a forged iron head and a golf club having the same, and more particularly, to a forged iron head which includes a hollow part, and a golf club having the same.

2. Description of the Related Art

Recently, golf players are on the rise both worldwide and nationwide. Unlike sports such as football, basketball and volleyball, golf is easy to play without limitation for physical conditions and is played under responsibilities of players. As golf is not violent, a wide range and variety of players including men, women, senior citizens and young people can enjoy it. Golf players may be in different genders, have large age gaps or performance gaps. Golf can be played by such various players competing with each other (e.g. by using handy cap, different tee box and teaming).

In golf, a plurality of golf clubs is used to hit a golf ball and winners are determined by the number of strokes until the golf ball is put in the determined hole cup. Here, the golf club used is controlled by rules. Any golf player desires to improve his/her play with a more efficient tool to thereby lower scores.

Thus, manufacturers who offer various types of golf equipment are meeting such demand and it can be recognized that there have been substantial development in various areas. Manufacturers have made every effort to develop good products from the material and shape of a driver or an iron head to shape and material of a shaft to a golf ball, and introduced new products.

Unlike other sports, golf is a sport that sensitively reacts to a swing posture of a player, a type of a golf club, a grip status of a handle part and mentality of a player. Accordingly, it is very important to select an appropriate golf club together with address, swing posture, etc. to improve performance/scoring of a player.

If a player hits a golf ball from fairway or green with a face of a head of a golf club, the golf ball progresses in a desired direction due to impact and repulsive force. As flight distances and direction of the golf ball may vary depending on the volume of the head and an inclination of the face, a player should select an appropriate golf club.

The number of golf clubs that a player may have in the game is typically limited to 14 golf clubs, which is called a full set. The full set includes four woods, nine irons and one putter.

An wood which is used to make a first shot or launch a golf ball to long flight distances includes a driver, a brush, a spoon, a buffy, a cleek, a heaven, a nine and an eleven. Among them, the driver is longest and hits the golf ball farthest.

The iron is used to hit the golf ball toward green after the firs shot, and includes golf clubs from no. 1 to no. 9. Each iron has different angles (about four degrees for each iron) of a face and a length of a shaft. When hitting the golf ball, the irons have different flight distances, typically 10 m different for each. The smaller the number of the iron is, the longer the flight distances are.

The golf club includes a head which has a hosel coupling a face as a hitting surface with respect to the golf ball and a shaft, a shaft coupled with the head and a handle part which is provided in an end part of the shaft to be gripped. The face of the head is coupled with a crown or a top as an upper part of the head and a sole as a lower part of the head by welding. That is, the head is shaped in several parts as necessary. The parts may be coupled with each other by TIG welding, MIG welding, laser welding, electron beam welding.

The golf club is an only device that moves the golf ball in the game. That is why the golf club has been the focus of technical studies and improved considerably in recent years.

Recently, the head is manufactured by various materials or a structural shape of the head is changed to improve flight distances and accuracy. If the head is manufactured, weight, material and strength of the head and a thickness of the face should be considered to improve performance of the golf club.

It is important to select a proper golf club together with efforts to hit the golf ball with a sweet spot accurately to improve the performance of a player. Particularly, it is very important to improve direction and flight distances of the golf ball by reducing the weight of the head accounting for a considerable portion of the weight of the golf club.

It is known that if a player hits a golf ball from a center of gravity of the head or from a sweet spot adjacent to the center of gravity of the face surface of the head, flight distances and direction of the golf ball improves. While the increased volume and weight of the head raises the dimension of the sweet spot, air resistance or drag force increases. Accordingly, hitting speed of the ball is reduced.

A factor which determines a direction of the golf ball about whether the golf ball flies in an intended direction is a center of gravity of the head. That is, if the center of gravity is positioned in a rear side of the face hitting the golf ball, the golf ball substantially flies straight. However, if the center of gravity is positioned in a lateral side of the face hitting the ball, the golf ball is curved in a left or a right side, which is called a hook or slice. If the center of gravity is positioned in an upper or lower side of the face hitting the golf ball, the golf ball flies down to the ground or is launched to a high trajectory.

It is known that the iron includes a metal such as wrought iron, titanium alloys, aluminum alloys, meraging, etc.

The most important purpose of such iron is to approach the ball from fairway to a hole cup of green to the maximum. Thus, a player generally uses irons selectively as each iron has different head weight and face angle.

A metal head may achieve a lowered centroid by giving more weight to a sole. Also, a volume of the head increases to extend the sweet spot.

SUMMARY OF THE INVENTION

However, a conventional forged iron head is limited in forming a cavity in a rear side thereof. That is, the cavity is not undercut and it is hard to lower the centroid of the head and move the center thereof to the rear side (depth of center of gravity).

Accordingly, it is an aspect of the present invention to provide a forged iron head which lowers a centroid by forming a hollow part, and a golf club having the same.

Also, it is another aspect of the present invention to provide a forged iron head which allows a player to easily hit a golf ball upwards (easy to hit) and improves flight distances and hitting sense, and a golf club having the same.

Additional aspects and/or advantages of the present invention will be set forth in part in the description which follows and, in part, will be obvious from the description, or may be learned by practice of the present invention.

The foregoing and/or other aspects of the present invention are also achieved by providing a forged iron head comprising a provisionally-forged member which is shaped like a substantial iron head with an original material; a head is forged the provisionally-forged material as a desired shape and has a face provided a face surface hitting a golf ball, a top and a sole extending to an upper part and a lower part of a rear side of the face, respectively, a heel and a toe disposed between the sole and the top and extending to the rear side of the face, a cavity disposed in the rear side of the face and surrounded by the sole, the top, the heel and the toe and a hosel coupled with a shaft extending from a first side of the face and having a handle part to be gripped by a player; and the head comprising a hollow part which has an opening formed from the sole toward a first side of the cavity, further comprising a sole cover which closes the opening.

Preferably, the hollow part is separated from one of a partition wall and a projection.

Preferably, the original material comprises a wrought iron.

The foregoing and/or other aspects of the present invention are also achieved by providing a forged iron head comprising a provisionally-forged member which is shaped like a substantial iron head with an original material; a head is forged the provisionally-forged material as a desired shape and has a face provided a face surface hitting a golf ball, a top and a sole extending to an upper part and a lower part of a rear side of the face, respectively, a heel and a toe disposed between the sole and the top and extending to the rear side of the face, a cavity disposed in the rear side of the face and surrounded by the sole, the top, the heel and the toe and a hosel coupled with a shaft extending from a first side of the face and having a handle part to be gripped by a player; and the head comprising a hollow part which penetrates a first side of the cavity from the sole.

The foregoing and/or other aspects of the present invention are also achieved by providing a forged iron head comprising a provisionally-forged member which is shaped like a substantial iron head with an original material; a head is forged the provisionally-forged material as a desired shape and has a face provided a face surface hitting a golf ball, a top and a sole extending to an upper part and a lower part of a rear side of the face, respectively, a heel and a toe disposed between the sole and the top and extending to the rear side of the face, a cavity disposed in the rear side of the face and surrounded by the sole, the top, the heel and the toe and a hosel coupled with a shaft extending from a first side of the face and having a handle part to be gripped by a player; and a hollow part which has an opening formed from the cavity toward the sole.

The foregoing and/or other aspects of the present invention are also achieved by providing a golf club which has a forged iron head, the golf club comprising: a handle part which is provided to be gripped by a player; a shaft whose upper side is coupled with the handle part; a head is forged a provisionally-forged member which is shaped like a substantial iron head with an original material as a desired shape and has a face provided a face surface hitting a golf ball, a top and a sole extending to an upper part and a lower part of a rear side of the face, respectively, a heel and a toe disposed between the sole and the top and extending to the rear side of the face, a cavity disposed in the rear side of the face and surrounded by the sole, the top, the heel and the toe and a hosel coupled with the shaft extending from a first side of the face and having the handle part; and the head comprising a hollow part which has an opening formed from the sole toward a first side of the cavity, further comprising: a sole cover which closes the opening.

The foregoing and/or other aspects of the present invention are also achieved by providing a golf club which has a forged iron head, the golf club comprising: a handle part which is provided to be gripped by a player; a shaft whose upper side is coupled with the handle part; a head is forged a provisionally-forged member which is shaped like a substantial iron head with an original material as a desired shape and has a face provided a face surface hitting a golf ball, a top and a sole extending to an upper part and a lower part of a rear side of the face, respectively, a heel and a toe disposed between the sole and the top and extending to the rear side of the face, a cavity disposed in the rear side of the face and surrounded by the sole, the top, the heel and the toe and a hosel coupled with the shaft extending from a first side of the face and having the handle part; and the head comprising a hollow part which penetrates a first side of the cavity from the sole.

The foregoing and/or other aspects of the present invention are also achieved by providing a golf club which has a forged iron head, the golf club comprising: a handle part which is provided to be gripped by a player; a shaft whose upper side is coupled with the handle part; a head is forged a provisionally-forged member which is shaped like a substantial iron head with an original material as a desired shape and has a face provided a face surface hitting a golf ball, a top and a sole extending to an upper part and a lower part of a rear side of the face, respectively, a heel and a toe disposed between the sole and the top and extending to the rear side of the face, a cavity disposed in the rear side of the face and surrounded by the sole, the top, the heel and the toe and a hosel coupled with the shaft extending from a first side of the face and having the handle part; and a hollow part which has an opening formed from the cavity toward the sole.

BRIEF DESCRIPTION OF THE DRAWINGS

The above and/or other aspects of the present invention will become apparent and more readily appreciated from the following description of the embodiments, taken in conjunction with the accompanying drawings of which.

DETAILED DESCRIPTION OF EXEMPLARY EMBODIMENT

Hereinafter, exemplary embodiments of the present invention will be described with reference to accompanying drawings, wherein like numerals refer to like elements and repetitive descriptions will be avoided as necessary.

A forged iron head 200 and a golf club 100 having the same according to the present invention will be described with reference to FIGS. 1 to 6.

Figure 1:
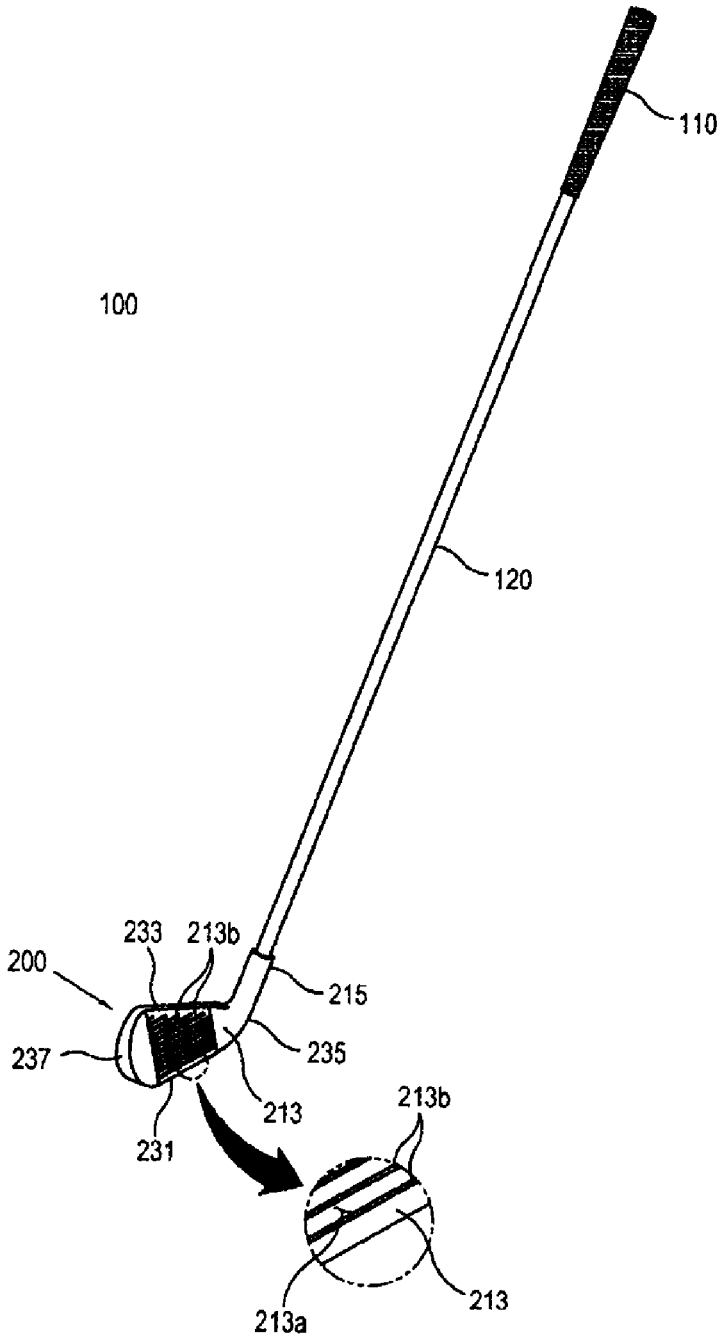
FIG. 1 is a perspective view of a golf club which has a forged iron head according to an exemplary embodiment of the present invention.

As shown in FIG. 1, the golf club 100 includes a handle part 110, a shaft 120 and a head 200.

Hereinafter, as shown in FIGS. 1 to 6, a face 213 which has a face surface 213*a* hitting a golf ball is called a front side while a rear part of the face 213 is called a rear side for purposes of convenience. Left and right sides connecting the front and rear sides is called a lateral side while upper and lower parts connecting the front and rear sides is called an upper part and a lower part.

The handle part 110 is provided to be gripped by a player. The handle part 110 provides a comfortable feeling to a player and prevents a sliding when a player grips the handle part 110 with hands or gloved hands. Various technologies are being developed for the handle part 110 so that a player performs a swing more stably.

The handle part 110 is attached to an upper part of the shaft 120 while the head 200 is coupled with a lower part of the shaft 120. The shaft 120 improves flight distances by influencing on a speed of the head 200 depending on a distribution of bending strength upon hitting a golf ball. The shaft 120 includes a reinforced fiber resin and/or plastic, steel material, etc. The shaft 120 typically has a round shape.

Figure 2:
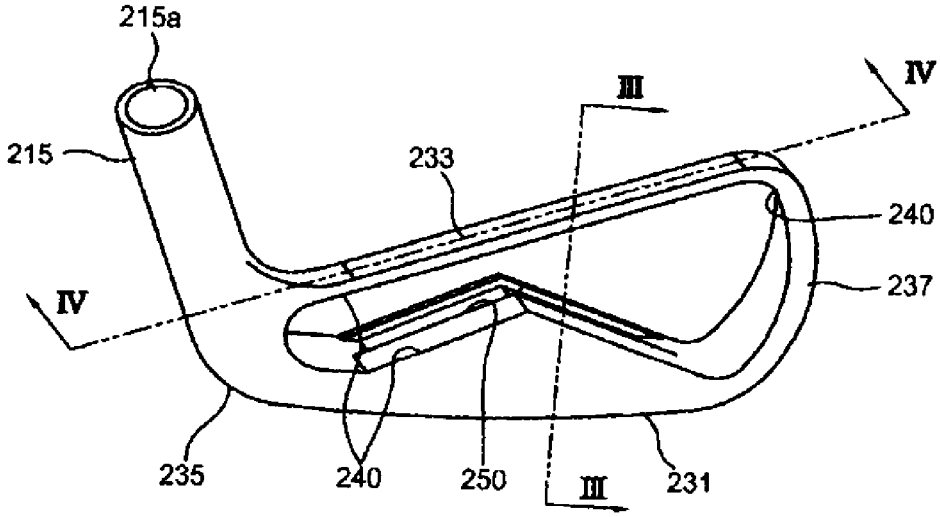
FIG. 2 is a rear perspective view of the forged iron head in FIG. 1.

AS shown in FIGS. 1 and 2, the head 200 includes a face 213 disposed in a front side and a hosel 215. The head 200 includes a sole 231 which extends to a rear side of the face 213 and disposed downwards, a top 233 which extends to the rear side of the face 213 and disposed upwards, a heel 235 which extends to the rear side of the face 213 and disposed between the sole 231 and the top 233 to be adjacent to the shaft 120, and a toe 237 which is spaced from the shaft 120.

The face 213 includes a face surface 213*a* to hit a golf ball. A groove 213*a* or a projection (not shown) may be formed in various shapes on the face surface 213*a*. Generally, the groove 213*b* intersects the face surface 213*a* and is in parallel with the sole 231. The groove 213*b* increases a frictional contact between the face surface 213*a* and a golf ball but reduces a strength of the face 213.

The sole 231 becomes closest to the ground when hitting the golf ball. The top 233 is disposed in an upper part of the head 200 facing the sole 231. The sole 231 connects the shaft 120 and the remaining part of the head 200, and partially absorbs a shock received to the golf ball when hitting the golf ball. An area where the hosel 215 and the face 213 meet is called a neck 217. A shaft hole 215*a* is formed in the hosel 215 to be coupled with the shaft 120.

As shown in FIG. 2, the cavity 240 is formed in the rear side of the face 213 and is a depressed area surrounded by the sole 231, the top 233, the heel 235 and the toe 237. The forged cavity 240 is not undercut due to the forging characteristic. However, such restriction may be overcome by a CNC operation equipment such as an end mill.

As shown in FIGS. 3A to 4B, the hollow part 250 is formed between the sole 231 and the cavity 240 in the rear side of the face 213.

Figure 3A:
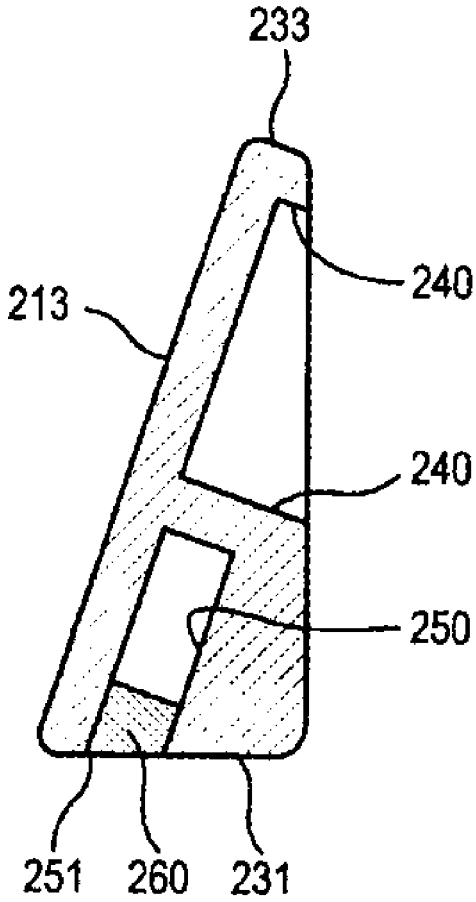
FIGS. 3A to 3C are sectional views of the forged iron head taken along line III-III in FIG. 2 to describe various exemplary embodiments.

First, the hollow part 250 according to a first exemplary embodiment of the present invention will be described with reference to FIG. 3A.

Figure 6:
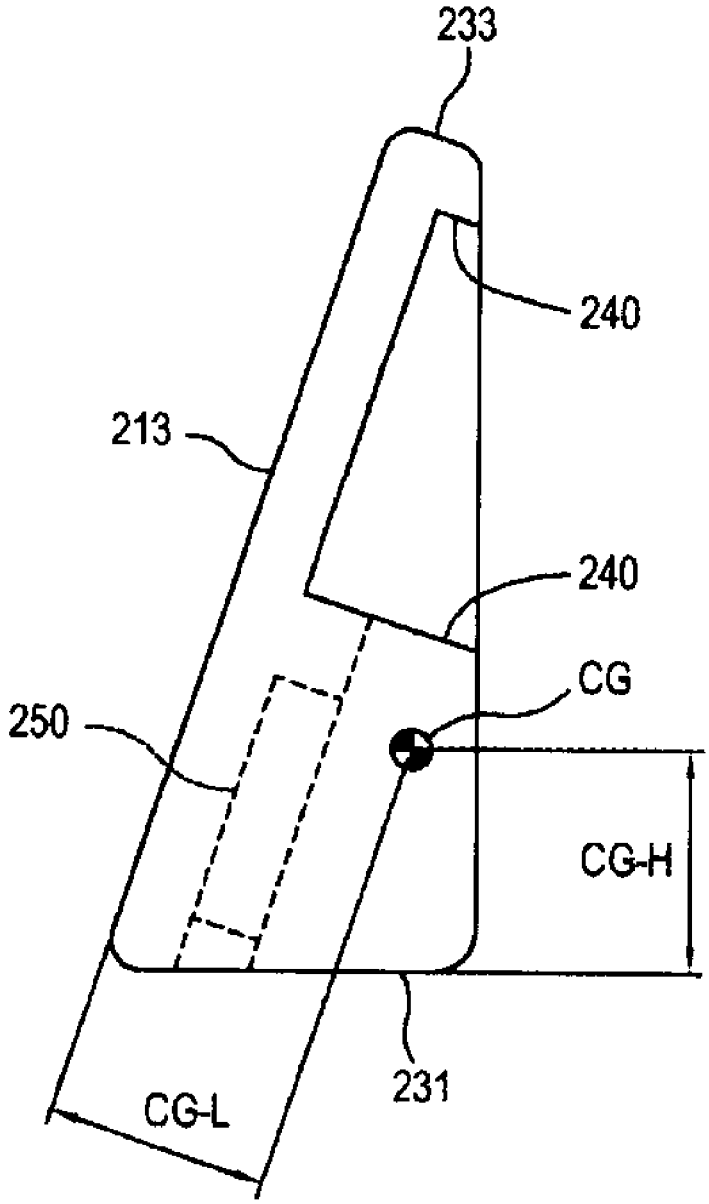
FIG. 6 is a sectional view to illustrate a center of gravity and describe effects in FIG. 1.

The hollow part 250 is processed toward a lower part of the cavity 240 from the sole 231. The hollow part 250 has an opening 251 which is formed only in a contact surface with the sole 231. Here, the opening 251 may be closed by a weight cover 260. The weight cover 260 may be coupled with the opening 251 by heating the opening 251 or the weight cover 260. Preferably, the density of the material of the weight cover 260 is higher than the density of the material of the face 213. That is, a center of gravity CG may be further lowered to achieve a lowered centroid of the head 200 by adding a weight to a lower part of the head 200 as shown in FIG. 6. The added weight is as much as the weight of weight cover 260 and is formed of a material having higher density than the material of the sole 231 or the face 213. Then a player may launch the golf ball in the air more easily when hitting the golf ball. Thus, direction of the ball, flight distances, etc. may improve. A tool which is used to process the hollow part 250 includes a CNC equipment such as an end mill.

Figure 3B:
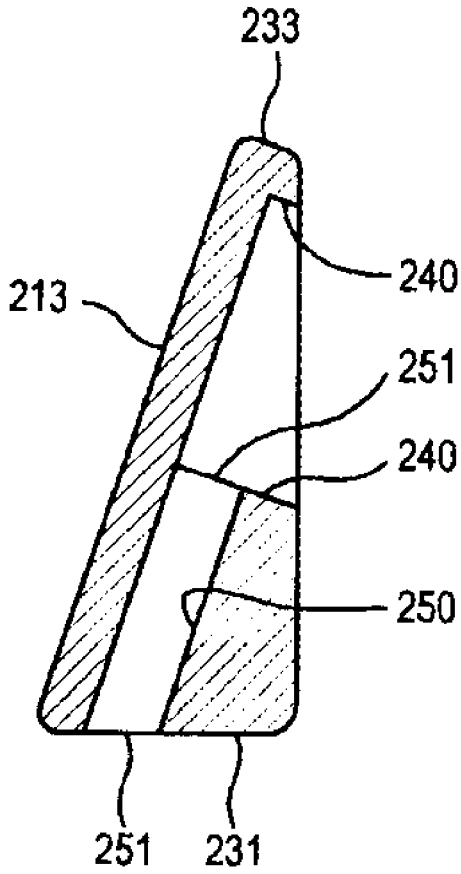

As shown in FIG. 3B, a hollow part 250 according to a second exemplary embodiment of the present invention penetrates the sole 231 and the cavity 240 while an opening 251 is formed in both upper and lower parts of the hollow part 250. Even though it is not shown in drawings, an upper part of the hollow part 250 may be covered by means such as a weight cover 260 according to the first exemplary embodiment of the present invention.

Figure 3C:
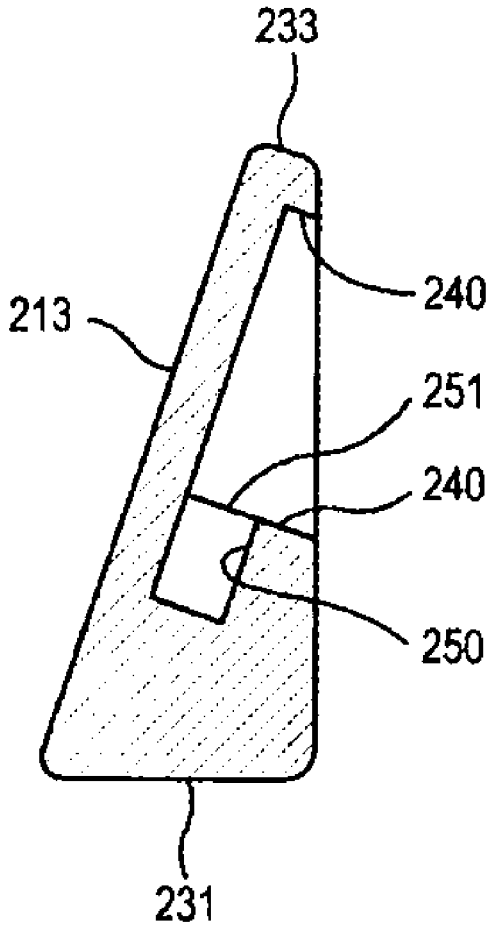

As shown in FIG. 3C, a hollow part 250 according to a third exemplary embodiment of the present invention is formed from a cavity 240 to a sole 231. The hollow part from the sole 231 is closed and an opening 251 is formed in a lower part of the cavity 240.

Preferably, the hollow part 250 is substantially formed in parallel with the face surface 231*a*. That is, the hollow part 250 has the same thickness or a thicker thickness than that from the face surface 213*a* to the cavity 240 in the rear side.

Figure 4A:
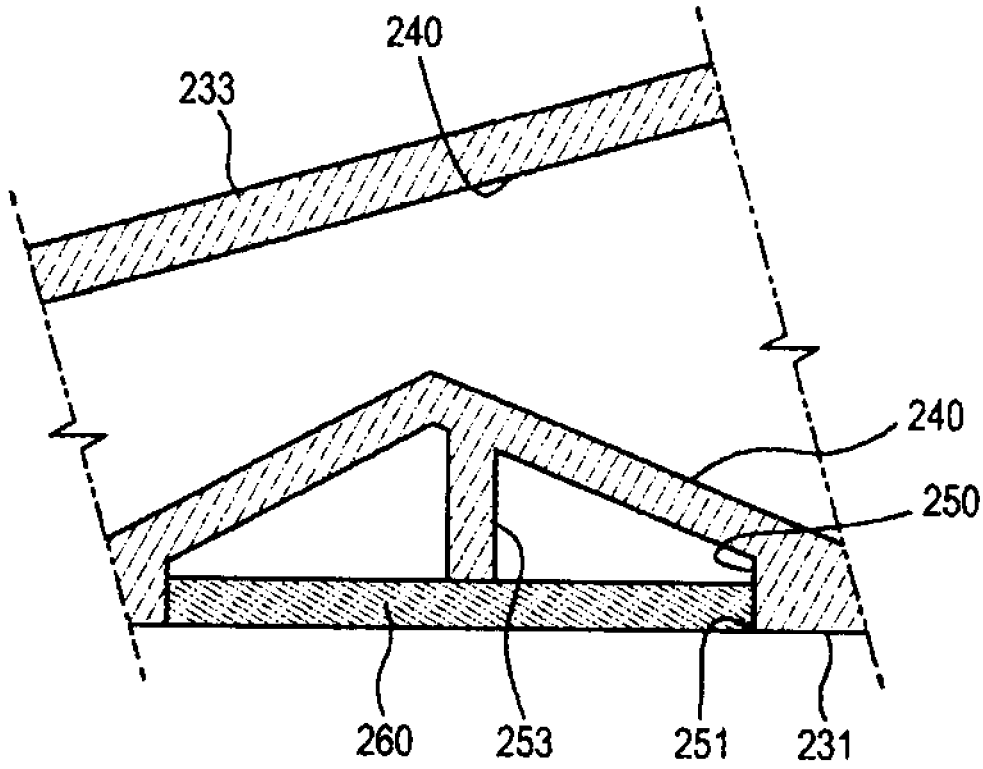
FIGS. 4A and 4B are sectional views of the forged iron head taken along line IV-IV in FIG. 2 to describe various exemplary embodiments.
Figure 4B:
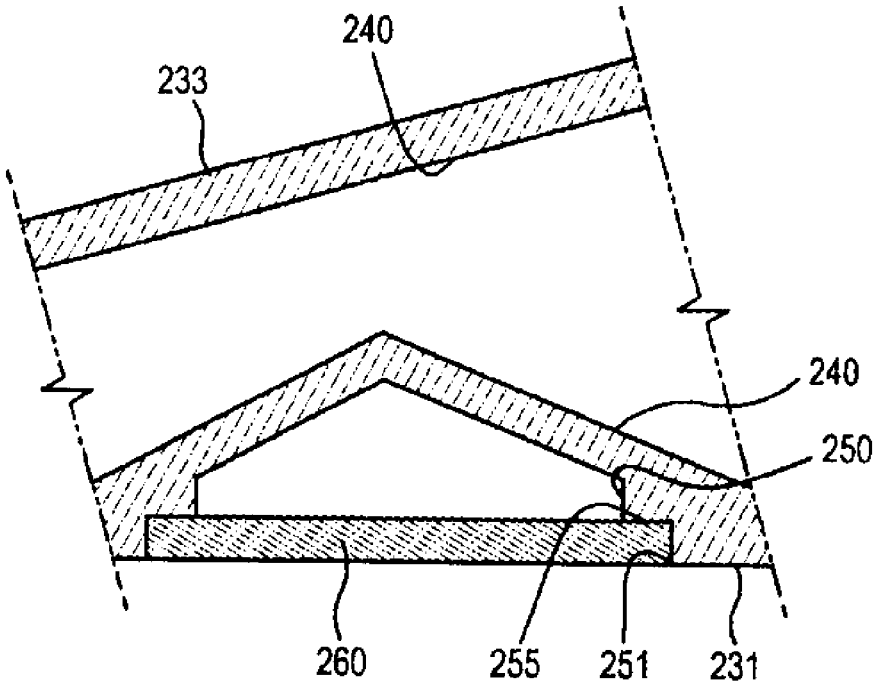

Here, FIGS. 4A and 4B illustrate sectional views of the hollow part 250. A cross-sectional surface of the hollow part 250 will be described with reference to FIGS. 4A and 4B.

As shown in FIG. 4A, a partition wall 253 or a projection (not shown) is formed in a central part of the hollow part 250 to act as a stopper in coupling the weight cover 260 to the opening 251.

As shown in FIG. 4B, a stepped part may be formed to be adjacent to the opening 251 of the hollow part 250 and coupled with the weight cover 260.

A forging process of the head 200 will be described with reference to FIGS. 5A and 5B.

Figure 5A:
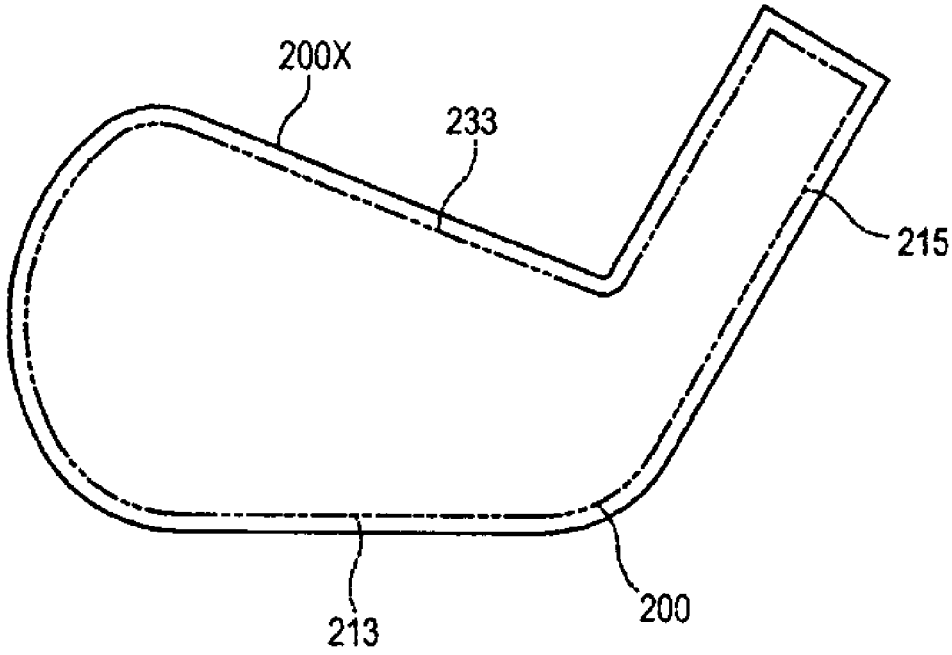
FIG. 5 is a front view and a sectional view to describe a forging process of the iron head in FIG. 1.

As shown in FIG. 5A, a provisional forging operation is performed by heating an original material and forming a head 200*x* having a substantial shape. For example, original materials which are shaped like round bars are heated and hit to integrally form a substantial shape of the head 200*x*.

Figure 5B:
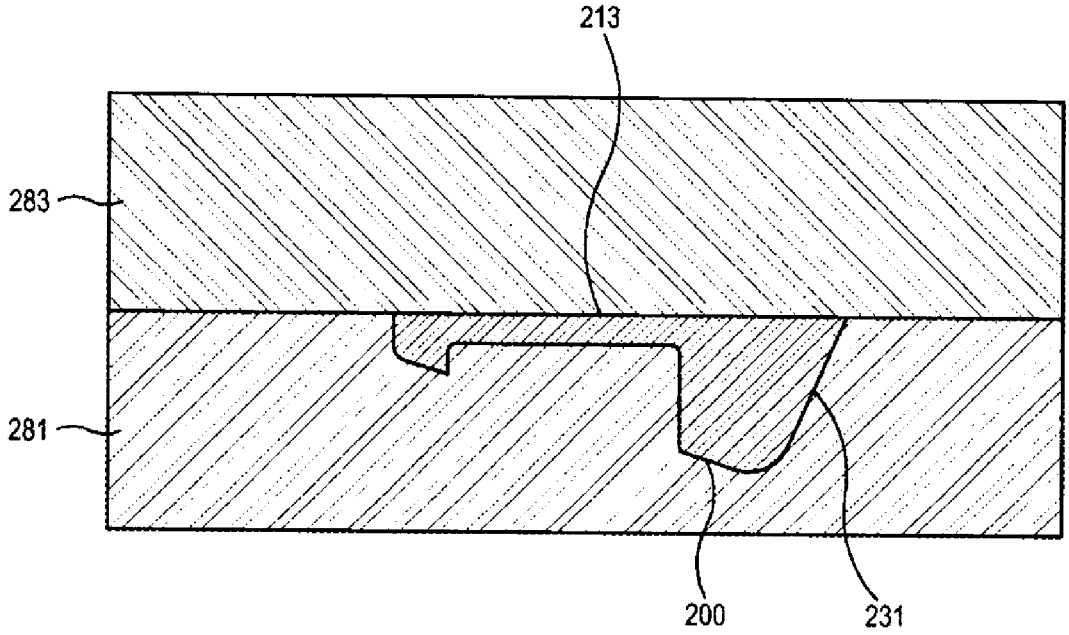

As shown in FIG. 5B, the provisional-forged head 200*x* is disposed in a forged lower type 281 fixed to a lower part of a press (not shown). Then, a forged upper type 283 which is movably provided in an upper part of the press is coupled with the forged lower type 281 and press the provisional-forged head 200*x*, which is a forging operation. Then, the head 200 is formed by the forging operation.

The head 200 may include stainless steel, titanium alloys, wrought iron, etc. Particularly, the wrought iron head 200 has good contraction and extraction and malleability. If the golf ball is hit by the head 200 including the wrought iron, contact time of the golf ball and the face 213 increases and at the same time contact dimension extends to provide a better stability for direction of the ball than a head including other materials do. Further, the head 200 provides better hitting sense than other heads including other materials do. Thus, the head 200 including the wrought iron is favored by professional golf players.

The effect of the head 200 according to the present invention will be described with reference to FIG. 6.

As described in the foregoing exemplary embodiments, the hollow part 250 is formed between the sole 231 and the cavity 240 and a weight as much as the hollow part 250 may be further added to the lower part of the head 200 such as the sole 231. Thus, the center of gravity CG of the head 200 is further lowered in comparison with the head 200 excluding the hollow part 250 to thereby achieve the lowered centroid. Also, the center of gravity may be moved to the rear side.

That is, not only the lowered centroid may be achieved with respect to the head 200, but also the center of gravity may be farther from the face 213. That is, a distance from the lower part of the sole 231 to the center of gravity CG (refer to "CG-H" in FIG. 6) may be shorter. Also, a distance from the face 213 to the center of gravity CG (refer to "CG-L" in FIG. 6) may be longer. If the golf ball is hit by the head 200, flight distances or direction of the golf ball may improve and the ball may fly more easily.

Figure 7:
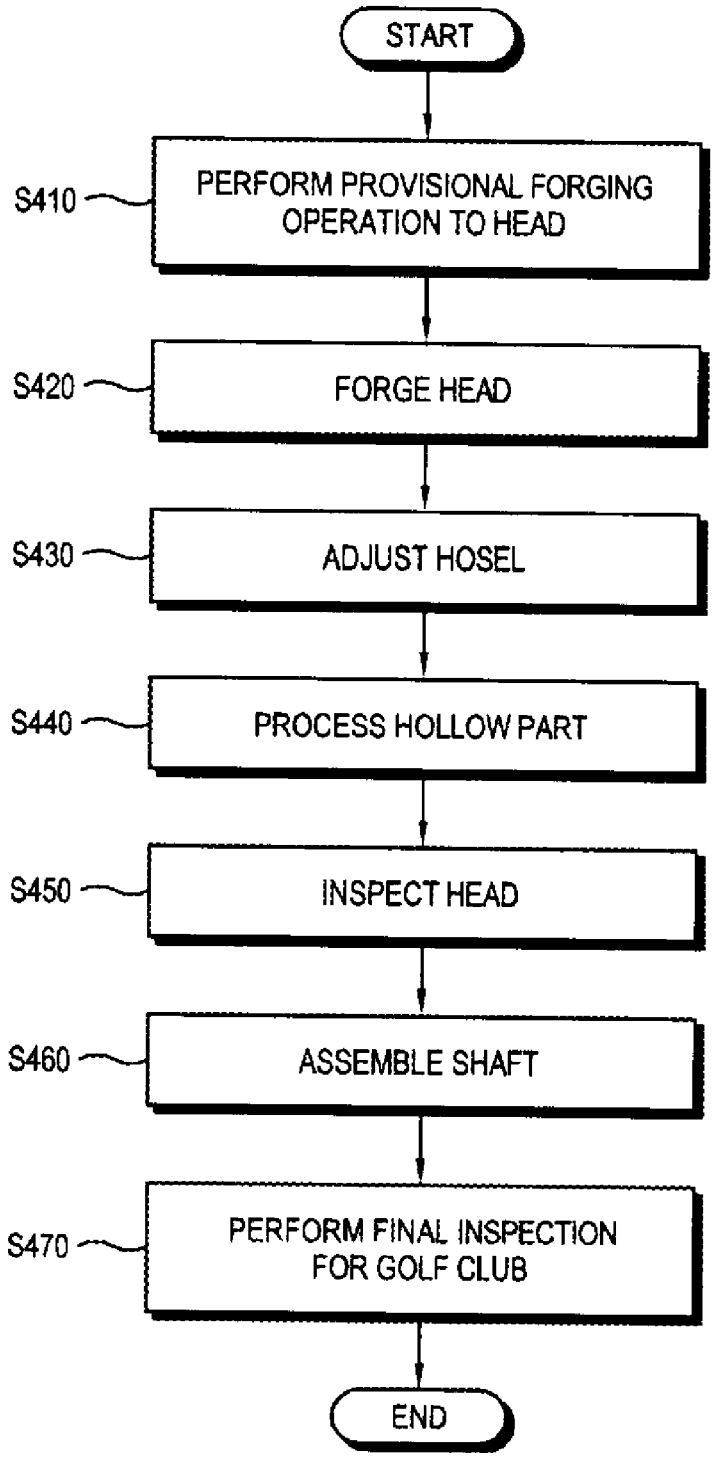
FIG. 7 is a flowchart to describe a manufacturing process of the golf club according to the present invention.

A manufacturing process of the forged iron head 200 and the golf club 100 having the same according to the present invention will be described with reference to FIGS. 1 and 7.

First, a provisional forging process (S410) forming the head 200 as a substantial shape of the head 200*x* and a forging process (S420) of the head 200 are described above. Thus, repetitive description will be avoided here. Provided, an unnecessary part which is formed in an end part of the head 200 which goes through the forging process is removed by a grinder, etc. Here, the cavity 240 may be processed and/or formed by NC or CNC equipment such as an end mill.

Then, the hosel 215 is adjusted (S430). That is, the hosel 215 is adjusted so that an angle of the hosel 215 with respect to the lower part of the face 213, an angle of the hosel 215 with respect to the face surface 213*a*, etc. comply with standards. After the adjustment, the shaft hole 215*a* is formed to couple the hosel 215 and the shaft 120. A screw may be formed in the shaft hole 215*a* depending on a coupling configuration of the shaft 120.

Then, the hollow part 250 is processed by the CNC equipment such as the end mill to form the opening 251. The weight cover 260 is coupled with the opening 251 by heat to close the opening 251 if necessary (S440).

The head 200 is finished and inspected (S450). The volume, weight and external appearance of the head 200, an angle formed between the face surface 213*a* and the hosel 215, an angle formed between the lower part of the sole 231 and the hosel 215 are inspected whether they comply with the determined standard. Before or after such inspection, the head 200 is ground or plated to make the external appearance of the head 200 better and improve the strength.

Then, the shaft 120 is coupled with the head 200 (S460). The shaft 120 having the handle part 110 is firmly coupled with the shaft hole 215*a* of the hosel 215. During this process, an adhesive agent (superglue, bond, etc) may be used to firmly couple the shaft 120 and the shaft hole 215*a*.

The golf club 110 goes through a final inspection (S470). The total weight, length, lie angle and external appearance of the golf club 100 coupled with the head 200 and the shaft 120 is inspected whether they are appropriate.

As described above, the hollow part 250 is formed between the sole 231 and the cavity 240, but not limited thereto. Alternatively, the hollow part 250 may be formed between the cavity 240 and the top 233, between the cavity 240 and the heel 235, between the cavity 240 and the toe 237 or in a combination thereof as necessary.

The foregoing iron head has the cavity in the rear side thereof. Alternatively, not only an iron head which does not have a cavity, but also an iron head which has a cavity having an open upper part and surrounded by the sole area with respect to the lateral area may be applicable.

According to the present invention, lowered centroid of an iron head may be achieved. As the depth of center of gravity is disposed in a further rear area than an existing head, a golf ball may be hit more easily (an easy-to-hit golf club), flight distances and direction of the ball may improve and credibility of the golf club may improve.

As the iron head includes wrought iron, direction and hitting sense may improve.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A forged iron head for use in a golf club, the head comprising:

a face having a surface for hitting a golf ball, a top and a sole extending to an upper part and a lower part of a rear side of the face, respectively, a heel and a toe disposed between the sole and the top and extending to the rear side of the face, a cavity disposed in the rear side of the face and surrounded by the sole, the top, the heel and the toe, a hosel coupled with a shaft extending from a first side of the face and having a handle part to be gripped by a player;

a hollow part which has an opening formed from the sole toward a first side of the cavity, wherein the hollow part is formed by milling a first volume of material having a first weight from the forged iron head; and a sole cover which closes the opening, wherein the sole cover has a second weight as much as the first weight, wherein the sole cover has a second volume smaller than the first volume;

the sole cover has a density higher than the density of the sole or the face;

the hollow part has an irregular depth when measured from the sole;

the hollow part has a depth which increases linearly before decreasing linearly in a direction away from the hosel; and the hollow part has a width larger than a distance from the face surface to the cavity, wherein the width is measured in a direction orthogonal to the face surface.

2. The forged iron head according to claim 1, wherein the face, top, sole, heel, toe, and hosel are formed of wrought iron.

3. The forged iron head according to claim 1, wherein the hollow part has a depth such that a distance from the cavity to the hollow part is substantially constant over the area of the hollow part.

4. The forged iron head according to claim 1, wherein the sole cover is formed of a material having higher density than a material of the face.

5. The forged iron head according to claim 4, further comprising:

a stepped part formed to be adjacent to the opening of the hollow part and to couple with an edge of the sole cover.

6. The forged iron head according to claim 1, further comprising:

a projection formed in a central part of the hollow part; and wherein the sole cover contacts with an end of the projection.

7. The forged iron head according to claim 6, wherein the projection is a partition wall that partitions the hollow part into two hollow parts, and wherein the sole cover contacts with the end of the partition wall such that the two hollow parts are closed by the sole cover.

8. The forged iron head according to claim 1, wherein the sole cover is formed of a material having higher density than a material of the sole.

9. A golf club which has a forged iron head, the golf club comprising:

a handle part which is provided to be gripped by a player;

a shaft whose upper side is coupled with the handle part;

a forged head comprising:

a face having a surface for hitting a golf ball, a top and a sole extending to an upper part and a lower part of a rear side of the face, respectively, a heel and a toe disposed between the sole and the top and extending to the rear side of the face, a cavity disposed in the rear side of the face and surrounded by the sole, the top, the heel and the toe, a hosel coupled with the shaft extending from a first side of the face and having the handle part;

a hollow part which has an opening formed from the sole toward a first side of the cavity;

a projection formed in a central part of the hollow part; and a sole cover which closes the opening and contacts with an end of the projection such that the projection acts as a stopper and a hollow cavity is formed around the projection in the hollow part.

10. The golf club according to claim 9, wherein the projection is a partition wall that partitions the hollow part into two hollow parts, and wherein the sole cover contacts with the end of the partition wall such that the two hollow parts are closed by the sole cover.

11. The golf club according to claim 9, wherein an angle of the hosel with respect to the lower part of the face and an angle of the hosel with respect to the face surface comply with predetermined standards.

* * * * *